US006142797A

United States Patent [19]

Bailey

[11] Patent Number: 6,142,797

[45] Date of Patent: Nov. 7, 2000

[54] ELECTRICAL PLUG LOCKING DEVICE

[76] Inventor: Craig Bailey, 1221 11th St., Rapid City, S. Dak. 57701

[21] Appl. No.: 09/437,786

[22] Filed: Nov. 10, 1999

[51] Int. Cl.[7] ..... H01R 13/44

[52] U.S. Cl. ..... 439/134; 439/133; 439/304; 70/57

[58] Field of Search ..... 439/133, 134, 439/135, 149, 304; 70/57, 58, 167, 168, 39, 360, 448

[56] References Cited

U.S. PATENT DOCUMENTS

| | | | |
|---|---|---|---|
| 2,654,073 | 9/1953 | Katz | 439/134 |
| 2,664,734 | 1/1954 | McEneaney | 439/134 |
| 2,733,416 | 1/1956 | Evalt | 339/37 |
| 4,143,933 | 3/1979 | Aitkins | 439/134 |
| 4,445,738 | 5/1984 | Wiencke | 439/304 |
| 5,055,057 | 10/1991 | Boyer | 439/133 |
| 5,169,326 | 12/1992 | Werner | 439/134 |
| 5,171,155 | 12/1992 | Mendoza | 439/134 |
| 5,277,599 | 1/1994 | Nilson | 439/133 |
| 5,330,361 | 7/1994 | Brend | 439/134 |
| 5,666,829 | 9/1997 | Aikens | 70/57 |
| 5,795,166 | 8/1998 | Meixler | 439/134 |
| 5,848,905 | 12/1998 | Patel | 439/134 |

*Primary Examiner*—Paula Bradley
*Assistant Examiner*—Tho D. Ta
*Attorney, Agent, or Firm*—Richard C. Litman

[57] ABSTRACT

An electrical plug locking device that prevents the unauthorized use of electrical devices. The locking device employs an innovative key actuated cam and cam slide locking mechanism to securely engage the prongs of an electrical plug. The locking device is strong, durable, and tamper resistant.

6 Claims, 3 Drawing Sheets

ELECTRICAL PLUG LOCKING DEVICE

BACKGROUND OF THE INVENTION

1. Field of the Invention

The present invention relates generally to locking devices and more particularly, to an electrical plug locking device made of injection molded plastic parts and punch pressed metal parts. The locking device prevents unwanted or unauthorized use of electrical devices.

2. Description of the Related Art

Frequently, people want to control the access or availability of various electrical devices, for example, parents may want to limit the amount of television their children watch or a person may want to limit the use of an electrical appliance. The most efficient and effective way to achieve that goal is to ensure that the electrical device does not receive electrical power, therefore, the electrical device cannot be turned on. The prior art is replete with locking devices for securing the plug of an electrical device such as a television or an appliance.

A locking device for use with electrical plugs is described in U.S. Pat. No. 2,733,416 issued on Jan. 31, 1956 to G. J. Evalt. The locking device uses a spring locking mechanism to secure the prongs of a plug. U.S. Pat. No. 5,277,599 issued on Jan. 11, 1994 to D. L. Nilson describes a lockable container for securing an electrical connector. The locking device consists of a container that encloses an electrical plug. An electrical plug locking device is described in U.S. Pat. No. 5,330,361 issued on Jul. 19, 1994 to G. W. Brend. The locking device consists of two opposing hemi-spherical housing elements that enclose an intermediate guide lever and a guide plate.

U.S. Pat. No. 5,666,829 issued on Sep. 16, 1997 to I. Aikens describes a plug lock. The locking device consists of a case having a shaft, the shaft having a pair of inverted U-shaped cut portions that pivot outwardly. A self contained child resistant electrical plug safety lock is described in U.S. Pat. No. 5,795,166 issued on Aug. 18, 1998 to L. D. Meixler. The locking device captively surrounds the prongs of an electrical plug. U.S. Pat. No. 5,848,905 issued on Dec. 15, 1998 to N. Patel describes a plug lock. The locking device has a lock base and a U-shaped member.

None of the above inventions and patents, taken either singularly or in combination, is seen to describe the instant invention as claimed. Thus a electrical plug locking device solving the aforementioned problems is desired.

SUMMARY OF THE INVENTION

Accordingly, it is a principal object of the invention to provide an electrical plug locking device that is strong, durable, and straightforward to use.

It is another object of the invention to provide an electrical plug locking device that is inexpensive and commercially viable.

It is a further object of the invention to provide an electrical plug locking device that has an innovative simplicity of design and function.

Still another object of the invention is to provide an electrical plug locking device that requires a minimal number of parts.

It is an object of the invention to provide improved elements and arrangements thereof for the purposes described which is inexpensive, dependable and fully effective in accomplishing its intended purposes.

The foregoing objectives are achieved by providing an electrical locking device that prevents unauthorized use of electrical devices. The locking device of the present invention employs a key actuated cam and cam slide locking mechanism to secure the prongs of an electrical plug. The locking device is made of injection molded plastic and punch pressed metal parts and requires a minimal number of parts which ensures low manufacturing and consumer costs. The locking device is durable and tamper resistant.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
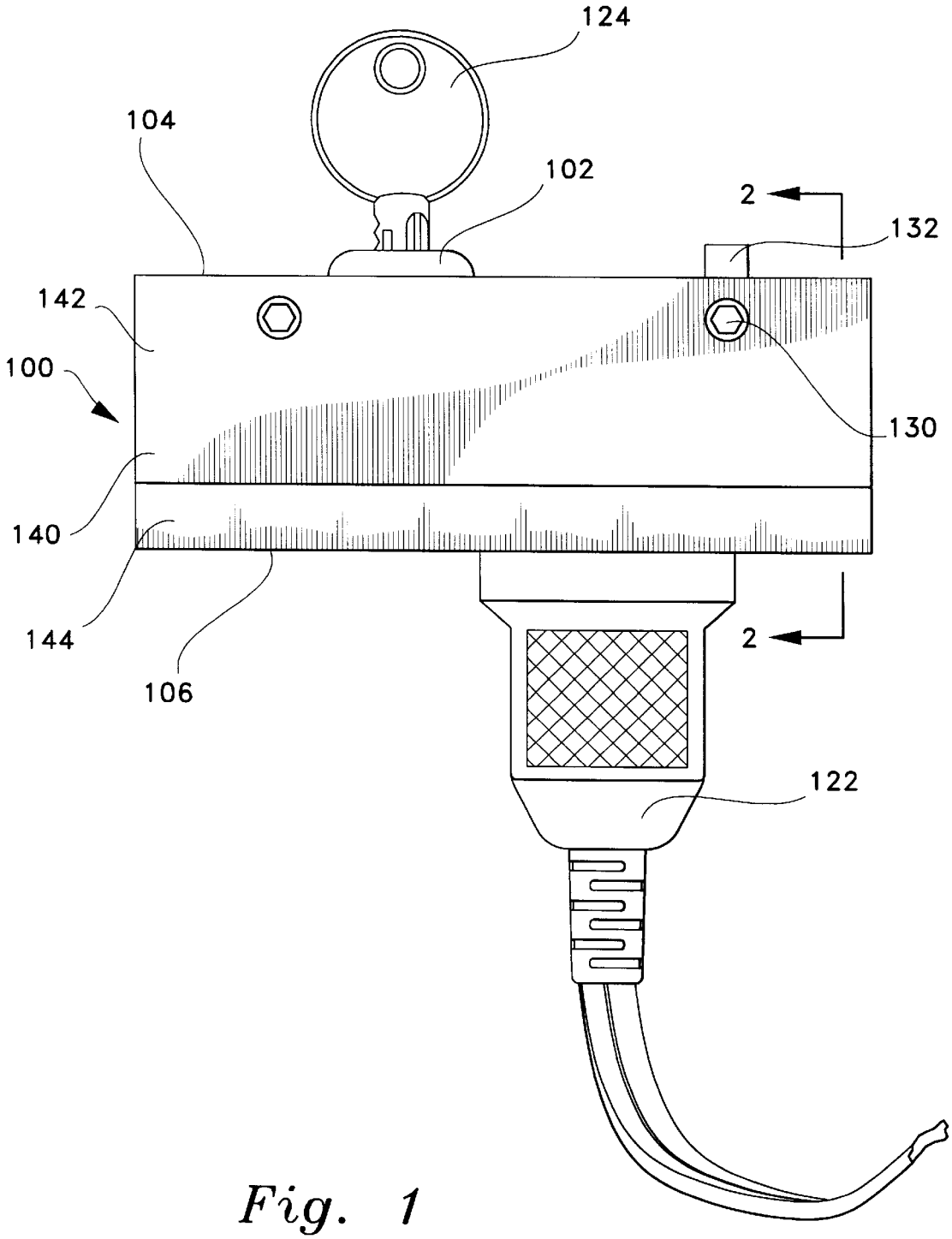
FIG. 1 is an environmental, side view of an electrical plug locking device according to the present invention.
Figure 2:
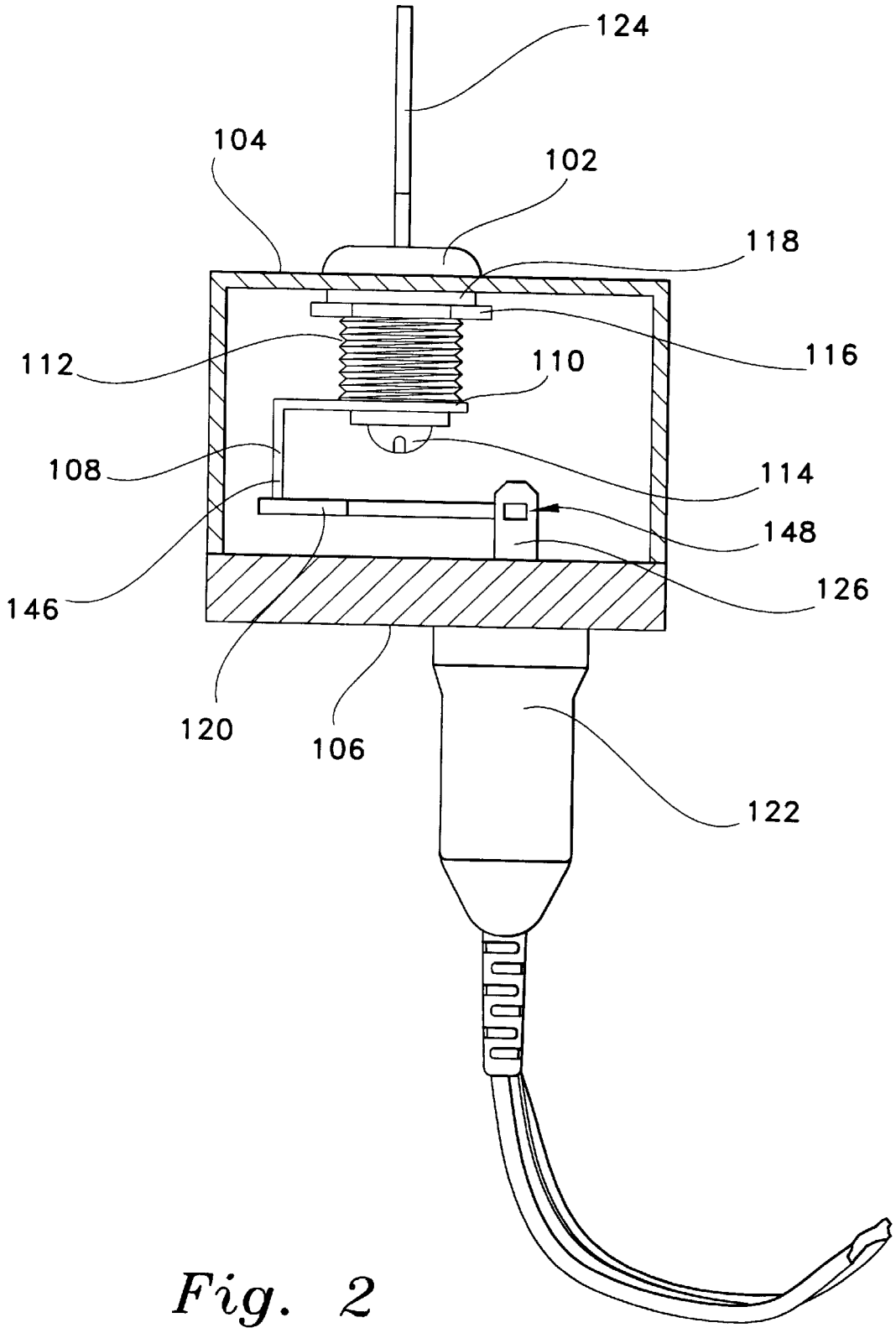
FIG. 2 is a cross-sectional view of the electrical plug locking device drawn along lines 2—2 of FIG. 1 showing the operative coupling of the cam—cam slide mechanism.

The electrical plug locking device 100 of the present invention securely disables electrical plugs 122 and prevents unauthorized use of electrical equipment and devices. FIG. 1 shows an environmental, side view of the electrical plug locking device 100. The locking device 100 of the present invention is used by inserting the prongs 126 of a plug 122 into the bottom side 106 of the locking device 100 and turning the key 124 in the lock 102 on the top side 104 of the locking device 100. The bottom or rear surface 106 of the locking device 100 has a set of openings 134,152 to accommodate the prongs 126 of a plug 122. The openings comprise a pair of adjacent rectangular shaped openings 152 that are parallel to each other and a circular opening 134 disposed beneath the pair of rectangular shaped openings 152. Therefore, the locking device 100 can readily accommodate two prong or three prong plugs 122. The locking device 100 comprises a modular rectangular shaped housing 140, a lock 102, a cam 108, and a cam slide 120. The functional components 102,108,120 of the locking device 100 are disposed between the top side 104 and the opposing bottom side 106 of the housing 140 as depicted in FIG. 2. The modular housing 140 is assembled using adhesives and screws 130,132 and comprises injection molded body parts 140 and punch pressed metal parts 120. In a preferred embodiment, a top piece 142 snaps down onto a bottom piece 144.

Figure 4:
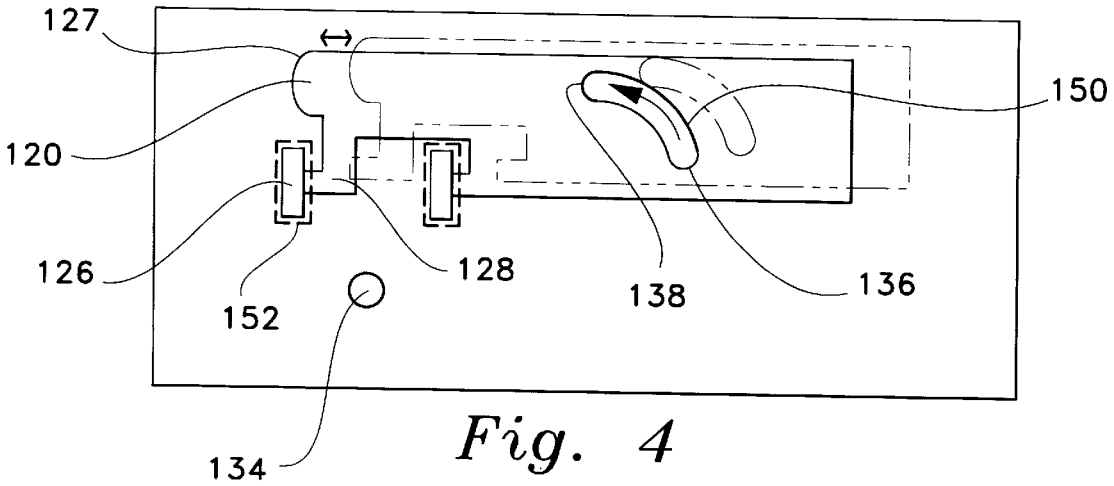
FIG. 4 is a front view of the cam slide slidably engaging the contacts or prongs of an electrical plug.

FIG. 2 is a cross-sectional view of the electrical plug locking device 100 drawn along lines 2—2 of FIG. 1 showing the operative coupling of the cam 108 and cam slide 120 mechanism. The cam 108 is an L-shaped component comprising an elongated body 110 and an integrally formed perpendicular appendage 108 that is shorter in length than the body segment 110. The elongated body 110 of the cam 108 is operatively coupled to the lock barrel 112 by a screw 114 and the perpendicular appendage 108 is operatively coupled to the cam slide 120. The cam slide 120 has a curved slot 150 into which the terminal end 146 of the perpendicular appendage 108 is inserted. The cam slide 120 is supported by a rectangular shaped piece of metal (not shown) disposed beneath the cam slide 120 which prevents the cam slide 120 from rotating and maintains rectilinear movement from side to side as the cam 108 is rotated in the slot 150. The cam slide 120 has a specially designed configuration as shown in FIG. 4. The contoured edge 127 of the cam slide 120 are smooth and beveled. The cam slide 120 is a flat plate having a pair of parallel feet 128 adapted for engaging the holes 148 in the prongs 126 of an electrical plug 122. The lock 124 is secured to the front or top surface 104 of the housing 140 by a washer 118 and nut 116.

Figure 3A:
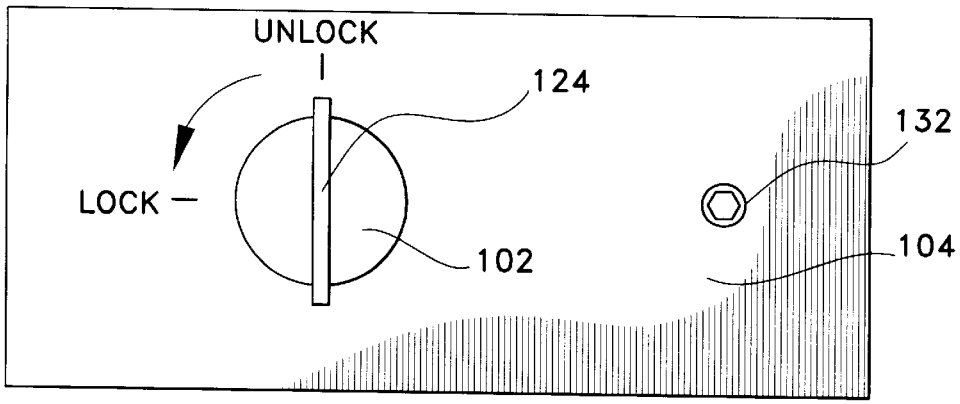
FIG. 3A is a front view of the top side of the electrical plug locking device showing the location of the lock.
Figure 3B:
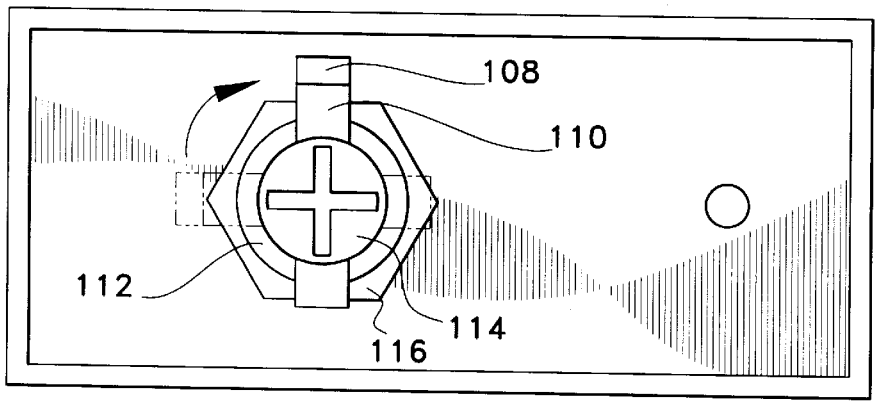
FIG. 3B is a rear view of the top side of the electrical plug locking device showing the coupling of the lock and cam.

In a preferred embodiment, the locking device 100 is locked by turning the key 124 in the lock 102 90° counter-clockwise as shown in FIG. 3A which rotates the lock cam 108 90° into a vertical orientation as shown in FIG. 3B. The rotation of the cam 108 causes the cam slide 120 to slide in the direction of the rotation of the cam 108 as the terminal end 146 of the perpendicular appendage 108 moves from the distal end 136 of the curved slot 150 to the proximal end 138 as shown in FIG. 4. The cam slide 120 has a pair of feet 128 having beveled edges that slide through and engage the holes 148 in the prongs 126 of a standard electrical cord plug 122. With the key 124 removed and the lock 102 in the locked position, the plug 122 is locked into the locking device 100 and safe from unauthorized use. Turning the key 124 90° clockwise to the unlocked position rotates the cam 108 90° into a horizontal orientation and disengages the cam slide 120 from the prongs 126 of the plug 122 by sliding cam slide 120 back to the open unlocked position shown in phantom in FIG. 4. The key 124 can only be removed when the lock is in either the locked or unlocked position.

The electrical plug locking device of the present invention has an innovative simplicity of design and requires a minimal number of parts which results in a low manufacturing cost. In a preferred embodiment, the metal components of the locking device are made of steel. The locking device can be used by parents, care providers, and anyone responsible for the welfare of others or anyone responsible for the controlled access. The locking device of the present invention enables parents to control the use of televisions, VCRs, and video games. The locking device is sturdy, durable, and straightforward to use.

The preferred embodiments of the present invention disclosed herein are intended to be illustrative only and are not intended to limit the scope of the invention. It should be understood by those skilled in the art that various modifications and adaptations of the present invention as well as alternative embodiments of the present invention may be contemplated. It is to be understood that the present invention is not limited to the embodiments described above, but encompasses any and all embodiments within the scope of the following claims.

I claim:

1. An electrical plug locking device comprising:

a rectangular shaped housing having a top side and an opposing bottom side, said top side having a lock and said bottom side having openings to accommodate a pair of prongs of an electrical plug, said lock being coupled to a cam inserted in a slot defined in a cam slide so that when said lock turns, said cam rotates in order to cause rectilinear movement of said cam slide; and when said cam slide slides in a locked position by said rectilinear movement, a portion of said cam slide engages the prongs of the electrical plug whereby said engagement prevents the removal of the plug from said housing.

2. An electrical plug locking device according to claim 1, wherein said cam slide is a flat plate having two parallel feet adapted for engaging a pair of holes defined in the prongs of the electrical plug.

3. An electrical plug locking device according to claim 1, further comprising a key removably inserted into said lock for locking and unlocking said plug locking device.

4. A locking device for securing the prongs of an electrical plug comprising:

a rectangular shaped housing having a top side and a bottom side;

a lock disposed within said top side for locking and unlocking a pair of prongs of an electrical plug;

an L-shaped cam having an elongated body and a shorter perpendicularly disposed appendage, said elongated body being connected to said lock;

a cam slide having a curved slot, the appendage of said cam being inserted into the slot; and a set of openings in said bottom side to accommodate said prongs of said electrical plug.

5. A locking device for securing the prongs of an electrical plug according to claim 4, wherein the turning of said lock to a lock position causes rotation of said cam, and movement of said appendage in said curved slot causing said cam slide to slidably engage said prongs of said plug thereby preventing the removal of said plug from said housing.

6. A locking device for securing the prongs of an electrical plug according to claim 4, wherein said set of openings comprises a pair of rectangular shaped openings that are adjacent and parallel to each other and a circular opening disposed beneath the pair of parallel rectangular shaped openings, said set of openings being adapted for receiving an electrical plug with a ground prong.

* * * * *